US012163268B2

(12) United States Patent
Kang et al.

(10) Patent No.: US 12,163,268 B2
(45) Date of Patent: Dec. 10, 2024

(54) WASHING MACHINE AND CONTROL METHOD THEREOF

(71) Applicant: Samsung Electronics Co., Ltd., Suwon-si (KR)

(72) Inventors: Minji Kang, Suwon-si (KR); Hyeongcheol Kim, Suwon-si (KR); Eunsuk Bang, Suwon-si (KR); Jiyu Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 1007 days.

(21) Appl. No.: 17/137,692

(22) Filed: Dec. 30, 2020

(65) Prior Publication Data

US 2021/0198829 A1 Jul. 1, 2021

(30) Foreign Application Priority Data

Dec. 30, 2019 (KR) ..... 10-2019-0178311

(51) Int. Cl.
*D06F 33/38* (2020.01)
*D06F 23/02* (2006.01)
(Continued)

(52) U.S. Cl.
CPC ..... *D06F 33/38* (2020.02); *D06F 23/02* (2013.01); *D06F 33/37* (2020.02); *D06F 33/58* (2020.02);
(Continued)

(58) Field of Classification Search
CPC ..... D06F 33/37; D06F 33/38; D06F 33/57; D06F 33/58; D06F 34/22; D06F 35/002;
(Continued)

(56) References Cited

U.S. PATENT DOCUMENTS 10,000,884 B2 * 6/2018 Bang ..... D06F 35/002
10,844,973 B2 * 11/2020 Uchiyama ..... F16K 31/408
(Continued)

FOREIGN PATENT DOCUMENTS

JP 2017-196270 11/2017
JP 2019-58605 4/2019
(Continued)

OTHER PUBLICATIONS

Electronic translation of KR-2015-0000628 to Kang. (Year: 2015).*
(Continued)

*Primary Examiner* — Joseph L. Perrin
(74) *Attorney, Agent, or Firm* — STAAS & HALSEY LLP

(57) ABSTRACT

A washing machine includes a tub for accommodating a drum; a water supplier configured to supply water to the tub; a turbidity sensor configured to detect turbidity of water in the tub; a circulation bubble device configured to perform a circulation operation of circulating water in the tub and resupplying it to the tub or a bubble supply operation of generating bubbles and supplying them to the tub; and a controller configured to perform a first rinsing cycle when the turbidity of the water in the tub is higher than a first reference value, and control the water supplier so that water containing a softener is supplied to the tub and perform a second rinsing cycle by controlling the circulation bubble device to alternately perform the circulation operation and the bubble supply operation when the turbidity of the water in the tub is lower than the first reference value.

10 Claims, 15 Drawing Sheets

(51) Int. Cl.

| | |
|---|---|
| ***D06F 33/37*** | (2020.01) |
| ***D06F 33/58*** | (2020.01) |
| ***D06F 35/00*** | (2006.01) |
| ***D06F 39/02*** | (2006.01) |
| ***D06F 39/08*** | (2006.01) |
| *D06F 101/20* | (2020.01) |
| *D06F 103/20* | (2020.01) |
| *D06F 105/02* | (2020.01) |
| *D06F 105/06* | (2020.01) |
| *D06F 105/08* | (2020.01) |
| *D06F 105/42* | (2020.01) |

(52) U.S. Cl.
CPC ..... *D06F 35/002* (2013.01); *D06F 39/028* (2013.01); *D06F 39/085* (2013.01); *D06F 39/088* (2013.01); *D06F 2101/20* (2020.02); *D06F 2103/20* (2020.02); *D06F 2105/02* (2020.02); *D06F 2105/06* (2020.02); *D06F 2105/08* (2020.02); *D06F 2105/42* (2020.02)

(58) Field of Classification Search
CPC .... D06F 39/028; D06F 39/083; D06F 39/085; D06F 39/088; D06F 2103/14; D06F 2103/20; D06F 2105/02; D06F 2105/06; D06F 2105/42
See application file for complete search history.

(56) References Cited

U.S. PATENT DOCUMENTS

2012/0096652 A1* 4/2012 Choi ..... D06F 23/04 68/183
2012/0204607 A1* 8/2012 Yang ..... D06F 35/002 68/5 R
2013/0291313 A1* 11/2013 Seo ..... D06F 35/006 68/12.23
2016/0153134 A1* 6/2016 Bang ..... D06F 35/002 68/13 R
2017/0342639 A1* 11/2017 Kim ..... H02K 29/06

FOREIGN PATENT DOCUMENTS

| | | |
|---|---|---|
| JP | 2019-76442 | 5/2019 |
| JP | 2019-97964 | 6/2019 |
| KR | 10-0777276 | 11/2007 |
| KR | 10-2009-0107848 | 10/2009 |
| KR | 10-2010-0106037 | 10/2010 |
| KR | 10-2011-0133997 | 12/2011 |
| KR | 10-2012-0040793 | 4/2012 |
| KR | 10-2013-0143474 | 12/2013 |
| KR | 10-2015-0000628 | 1/2015 |
| KR | 10-2017-0135230 | 12/2017 |
| KR | 10-2019-0126975 | 11/2019 |
| KR | 10-2019-0129207 | 11/2019 |

OTHER PUBLICATIONS

Electronic translation of JP 2017-196270 to Uchiyama et al. (Year: 2017).*
International Search Report dated Apr. 16, 2021 from International Application No. PCT/KR2020/019425.

* cited by examiner

WASHING MACHINE AND CONTROL METHOD THEREOF

CROSS-REFERENCE TO RELATED APPLICATIONS

This application is based on and claims priority under 35 U.S.C. § 119 to Korean Patent Application No. 10-2019-0178311, filed on Dec. 30, 2019, in the Korean Intellectual Property Office, the disclosure of which is incorporated by reference herein in its entirety.

BACKGROUND

1. Field

The disclosure relate to a washing machine capable of washing laundry such as clothes.

2. Description of the Related Art

In general, washing machines (usually, drum washing machines) includes a tub for fresh water (washing water or rinsing water), a drum that is rotatably installed inside the tub to accommodate laundry, and a driving motor that generates a driving force for rotating the drum.

In addition, when the cylindrical drum rotates, the laundry inside the drum rises up and falls along the inner wall of the drum, so that washing is performed.

Such, the washing machine performs washing in a series of operation such as a washing cycle that separates dirt from laundry with water (washing water) in which detergent is dissolved, a rinsing cycle that rinses off bubble or residual detergent from laundry with detergent-free water (rinsing water), and a dehydration cycle that dehydrates laundry at high speed.

The rinsing cycle may include a process of injecting a softener together with water in the tub, and conventionally, a softener was introduced at the beginning of water supply for rinsing.

SUMMARY

Therefore, it is an aspect of the disclosure to provide a washing machine capable of determining whether to add a softener based on the turbidity of the water inside the tub during the rinsing cycle, and providing bubbles into the tub while circulating the water inside the tub when the softener is added.

In accordance with an aspect of the disclosure, a washing machine includes a tub for accommodating a drum; a water supplier configured to supply water to the tub through a detergent supply device; a turbidity sensor configured to detect turbidity of water in the tub; a circulation bubble device configured to perform a circulation operation of circulating water in the tub and resupplying it to the tub or a bubble supply operation of generating bubbles and supplying them to the tub; and a controller configured to perform a first rinsing cycle when the turbidity of the water in the tub is higher than a first reference value, and control the water supplier so that water containing a softener is supplied to the tub and perform a second rinsing cycle by controlling the circulation bubble device to alternately perform the circulation operation and the bubble supply operation when the turbidity of the water in the tub is lower than the first reference value.

The controller may be configured to compare the turbidity of the water with the first reference value when the first rinsing cycle is completed, and perform the first rinsing cycle again when the turbidity of the water of the tub is higher than the first reference value.

The controller may be configured to compare the turbidity of the water with a second reference value when the second rinsing cycle is completed, and stop performing the operation of the circulation bubble device and perform a bubble reduction cycle when the turbidity of the water of the tub is higher than the second reference value.

The controller may be configured to discharge the water in the tub to the outside when the turbidity of the water in the tub is lower than the second reference value.

The controller may be configured to perform dehydration cycle after the water in the tub is discharged to the outside.

The controller may be configured to determine the turbidity of water supplied to the tub as a reference turbidity value when the first rinsing cycle is initiated, and determine the first reference value and the second reference value based on the reference turbidity value.

The washing machine may further comprise an input configured to receive a user input; and the controller may be configured to perform the first rinsing cycle and the second rinsing cycle when receiving a softening course from a user through the input.

The turbidity sensor may be provided inside the lower side of the tub.

The washing machine may further comprise a pump configured to suck water from the tub; and the circulation bubble device may include a switching member configured to selectively forming a circulation passage for resupplying water discharged from the pump to the tub and a bubble supply passage for generating bubbles in the water discharged from the pump and supplying them to the tub; and a driver configured to drive the switching member.

The controller may be configured to control the driver so that water discharged from the pump alternately passes through the circulation passage and the bubble supply passage.

In accordance with an aspect of the disclosure, a control method of a washing machine comprising a tub for accommodating a drum, a water supplier configured to supply water to the tub through a detergent supply device, a turbidity sensor configured to detect turbidity of water in the tub, and a circulation bubble device configured to perform a circulation operation of circulating water in the tub and resupplying it to the tub or a bubble supply operation of generating bubbles and supplying them to the tub, the method may include performing a first rinsing cycle when the turbidity of the water in the tub is higher than a first reference value, and controlling the water supplier so that water containing a softener is supplied to the tub and perform a second rinsing cycle by controlling the circulation bubble device to alternately perform the circulation operation and the bubble supply operation when the turbidity of the water in the tub is lower than the first reference value.

Performing the first rinsing cycle may include comparing the turbidity of the water with the first reference value when the first rinsing cycle is completed, and performing the first rinsing cycle again when the turbidity of the water of the tub is higher than the first reference value.

The control method may further comprise comparing the turbidity of the water with a second reference value when the second rinsing cycle is completed, and stopping performing the operation of the circulation bubble device and performing a bubble reduction cycle when the turbidity of the water of the tub is higher than the second reference value.

The control method further comprise discharging the water in the tub to the outside when the turbidity of the water in the tub is lower than the second reference value.

The control method further comprise performing dehydration cycle after the water in the tub is discharged to the outside.

The control method further comprise determining the turbidity of water supplied to the tub as a reference turbidity value when the first rinsing cycle is initiated, and determining the first reference value and the second reference value based on the reference turbidity value.

The washing machine further comprise an input configured to receive a user input, and the method may further comprise performing the first rinsing cycle and the second rinsing cycle when receiving a softening course from a user through the input The turbidity sensor may be provided inside the lower side of the tub.

The washing machine may further comprise a pump configured to suck water from the tub; and the circulation bubble device may include: a switching member configured to selectively forming a circulation passage for resupplying water discharged from the pump to the tub and a bubble supply passage for generating bubbles in the water discharged from the pump and supplying them to the tub; and a driver configured to drive the switching member.

Performing the second rinsing cycle may include controlling the driver so that water discharged from the pump alternately passes through the circulation passage and the bubble supply passage.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
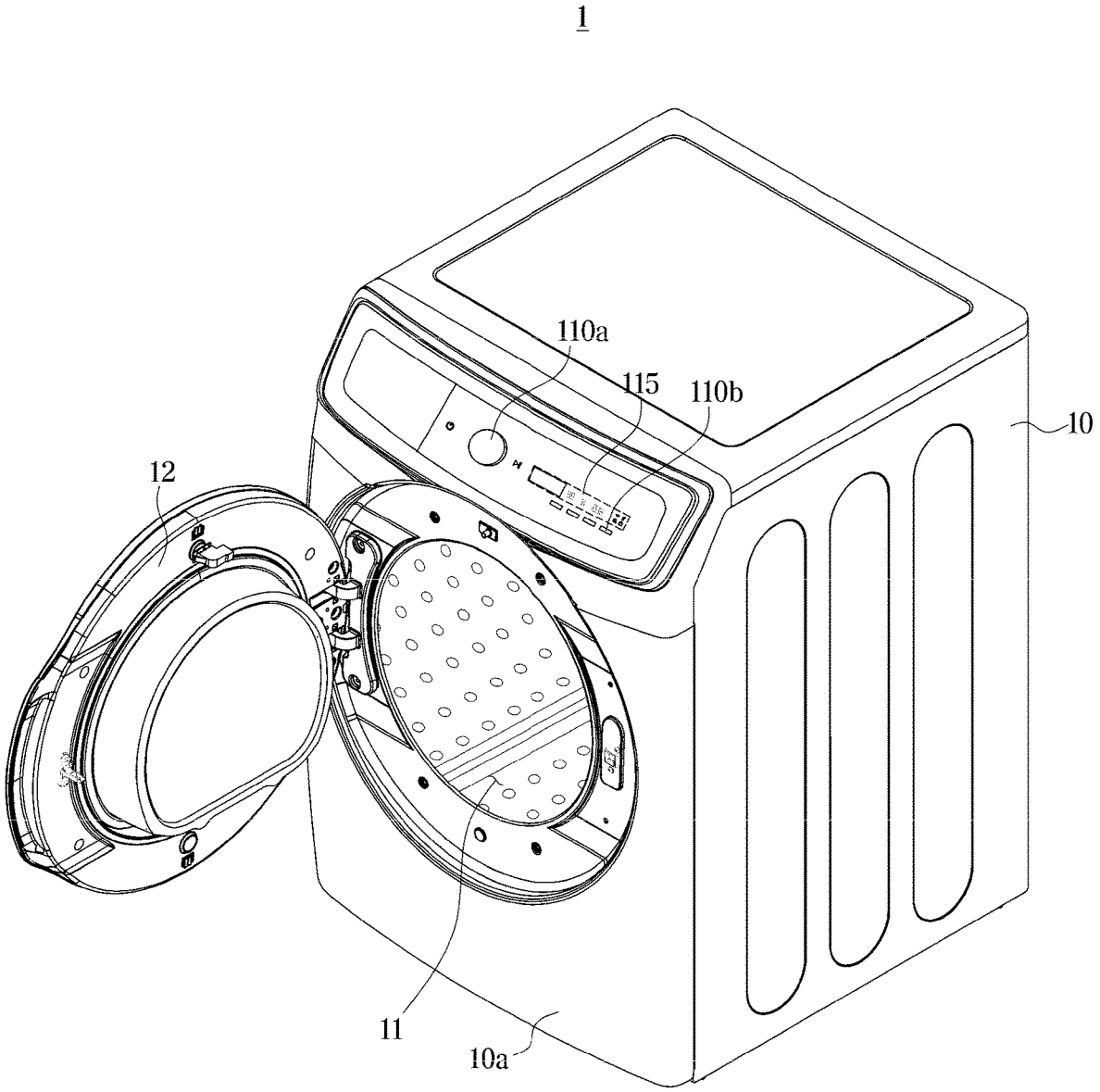
FIG. 1 illustrates an appearance of a washing machine according to an embodiment of the disclosure.

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The progression of processing operations described is an example; however, the sequence of and/or operations is not limited to that set forth herein and may be changed as is known in the art, with the exception of operations necessarily occurring in a particular order. In addition, respective descriptions of well-known functions and constructions may be omitted for increased clarity and conciseness.

Additionally, exemplary embodiments will now be described more fully hereinafter with reference to the accompanying drawings. The exemplary embodiments may, however, be embodied in many different forms and should not be construed as being limited to the embodiments set forth herein. These embodiments are provided so that this disclosure will be thorough and complete and will fully convey the exemplary embodiments to those of ordinary skill in the art. Like numerals denote like elements throughout.

It will be understood that, although the terms first, second, etc. may be used herein to describe various elements, these elements should not be limited by these terms. These terms are only used to distinguish one element from another. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present.

The terminology used herein is for the purpose of describing particular embodiments only and is not intended to be limiting. As used herein, the singular forms "a," "an," and "the," are intended to include the plural forms as well, unless the context clearly indicates otherwise.

In addition, terms such as "~ unit", "~ group", "~ block", "~ member", and "~ module" may mean a unit that processes at least one function or operation. For example, the terms may mean at least one hardware such as field-programmable gate array (FPGA)/application specific integrated circuit (ASIC), at least one software stored in a memory, or at least one process processed by a processor.

Reference will now be made in detail to the exemplary embodiments of the present disclosure, examples of which are illustrated in the accompanying drawings, wherein like reference numerals refer to like elements throughout.

Figure 2:
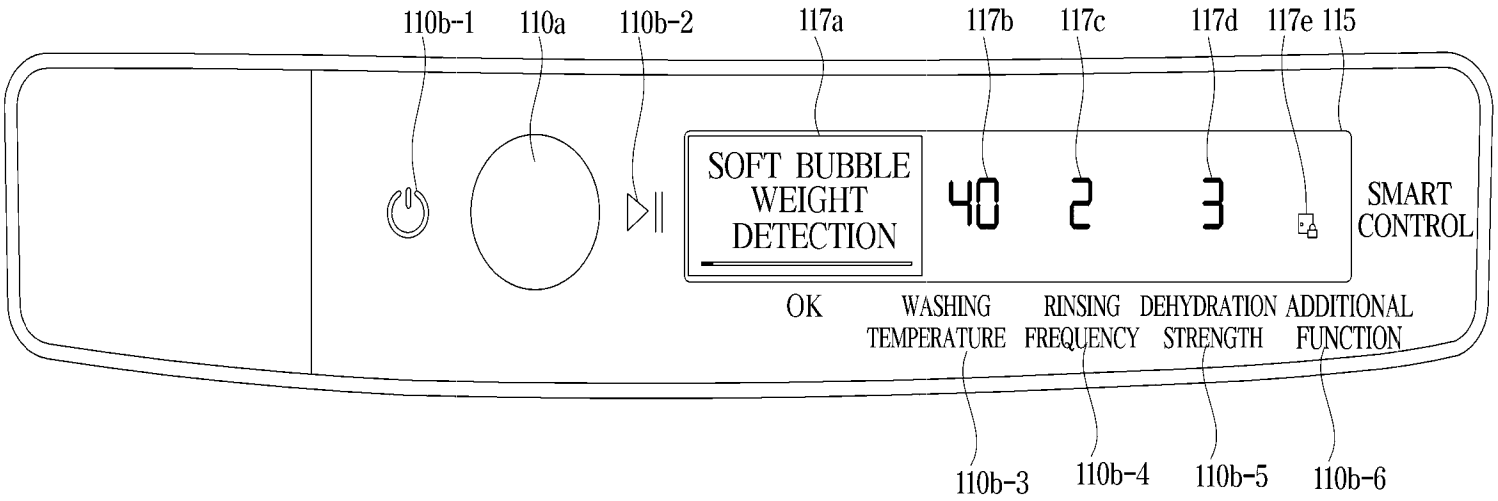
FIG. 2 illustrates an input of a washing machine according to an embodiment of the disclosure.
Figure 3:
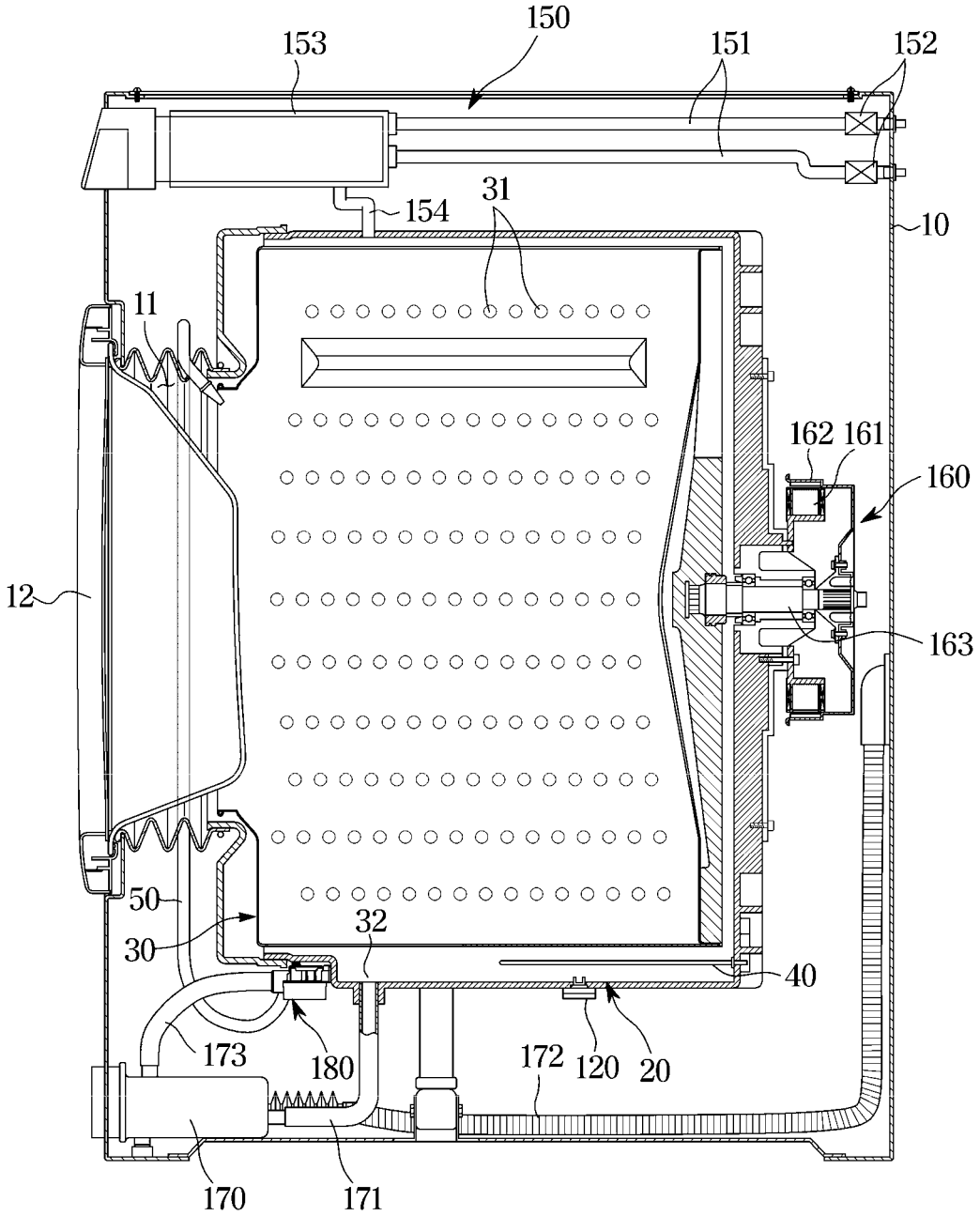
FIG. 3 is a side cross-sectional view of a washing machine according to an embodiment of the disclosure.
Figure 4:
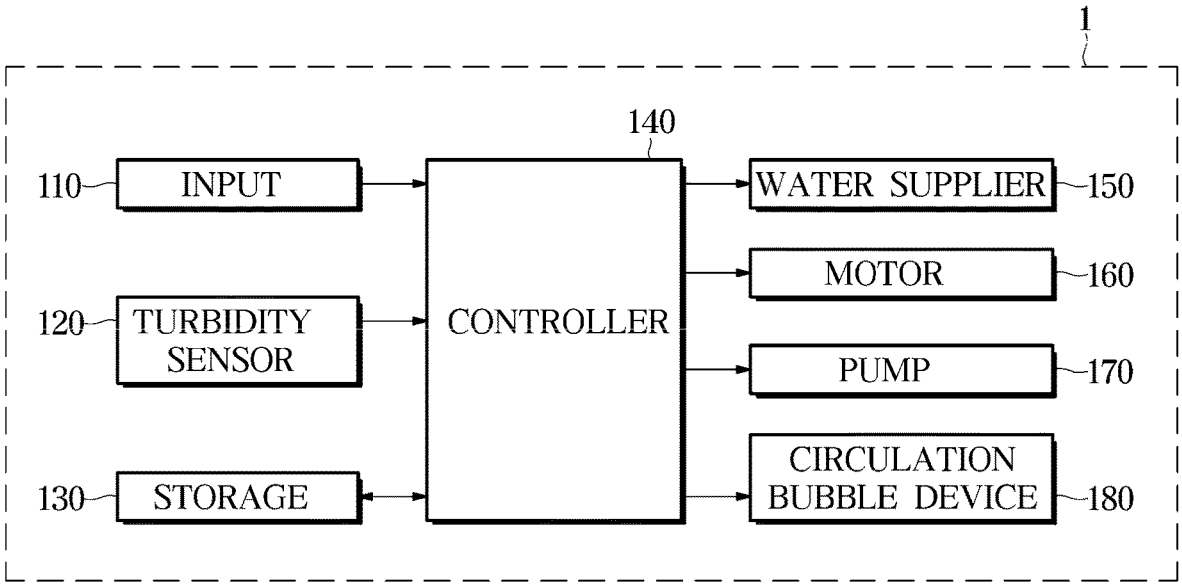
FIG. 4 is a control block diagram of a washing machine according to an embodiment of the disclosure.

FIG. 1 illustrates an appearance of a washing machine according to an embodiment of the disclosure; FIG. 2 illustrates an input of a washing machine according to an embodiment of the disclosure. FIG. 3 is a side cross-sectional view of a washing machine according to an embodiment of the disclosure. FIG. 4 is a control block diagram of a washing machine according to an embodiment of the disclosure.

Referring to FIGS. 1 to 4, the washing machine 1 according to an embodiment include a main body 10 forming the exterior, a tub 20 installed inside the main body 10 to store water during a washing cycle or a rinsing cycle, a drum 30 rotatably installed inside the tub 20 and forming a plurality of communication holes 31.

In the front cover 10*a* of the main body 10, an inlet 11 is formed to insert laundry into the drum 30, and a door 12 is installed to open and close the inlet 11.

On the top of the front cover 10*a*, an input unit, or interface, 110 for receiving a user's control command input and a display 115 for displaying various information on the operation of the washing machine 1 or guiding a user's input may be disposed.

Input 110 may be provided in the form of a jog shuttle or dial to allow the user to input a control command in a manner such as holding and turning or pressing the input unit 110*a*, or may be provided in the form of a touch pad or a button to allow the user to input a control command by touching or pressing the input unit 110*b*.

For example, input 110 may include an input unit 110*a* provided in the form of a jog shuttle and an input unit 110*b* provided in the form of a touch pad, as shown in FIG. 2.

At this time, the input unit 110*b*, may include a power button 110*b*-1 for receiving an input for power, an operation/pause button 110*b*-2 for receiving an input for the start or pause of an operation, a washing temperature button 110*b*-3 for receiving an input for adjusting the washing temperature, a rinsing frequency button 110*b*-4 for receiving an input for rinsing frequency cycle adjustment, a dehydration strength button 110*b*-5 for receiving an input for spin strength adjustment and, AND an additional function button 110*b*-6 for receiving an input for performing the additional function.

Input 110 according to an embodiment may receive an input for a desired course from a user. The user may input a desired course by holding and turning the input unit 110*a*. At this time, the display 115 may display a course selected every time the input unit 110*a* returns, and when a desired course is selected, the user presses the operation/pause button 110*b*-2 to select the desired course for controlling the washing machine 1.

For example, if the desired course corresponds to the softening course (soft bubble), the user may rotate the input unit 110*a* until the softening course is selected. If the softening course is selected, the washing machine 1 may be controlled so that the softening course is performed by pressing the operation/pause button 110*b*-2.

Also, input 110 may receive an input for detailed options from a user through the washing temperature button 110*b*-3, rinsing frequency button (110*b*-4), dehydration strength button 110*b*-5 or additional function button 110*b*-6.

As shown in FIG. 2, the input 110 may be provided in the order of a power button 110*b*-1, an input unit 110*a*, and an operation/pause button 110*b*-2 from the left according to an embodiment. That is, the power button 110*b*-1 may be provided on the left side of the input unit 110*a*, and the operation/pause button 110*b*-2 may be provided on the right side of the input unit 110*b*.

The display 115 may be implemented by various display panels such as LCD, LED, OLED, QLED, etc., and it is possible to perform the function of input 110 to receive input from the user by being implemented as a touch screen provided with a touch pad on the front side.

The display 115 may display a corresponding course 117*a* according to the rotation of the input unit 110*a*, and may display a washing temperature 117*b* selected through the washing temperature button 110*b*-3 or corresponding to a default setting value.

In addition, the display 115 may display the rinsing frequency 117*c* selected through the rinsing frequency button 110*b*-4 or corresponding to a default setting value, or may display a dehydration strength button 117*d* selected through the spin strength button 110*b*-5 or corresponding to a default setting value, or display the additional function 117*e* selected through the additional function button 110*b*-6.

As shown in FIG. 2, according to an embodiment, the display 115 displays a course 117*a*, a washing temperature 117*b*, a rinsing frequency 117*c*, a dehydration strength 117*d*, and an additional function 117*e* from left. That is, the course 117*a* may be displayed on the right side of the operation/pause button 110*b*-2, the washing temperature 117*b* may be displayed on the right side of the displayed course 117*a*, and the rinsing frequency 117*c* may be displayed on the right side of the displayed washing temperature 117*b*, the dehydration strength 117*d* may be displayed on the right side of the displayed rinsing frequency 117*c*, the additional function 117*e* may be displayed on the right side of the displayed dehydration strength 117*d*.

At this time, each of the washing temperature button 110*b*-3, the rinsing frequency button 110*b*-4, the dehydration strength button 110*b*-5, and the additional function button 110*b*-6 of the input 110 as shown in FIG. 2 may be provided at the bottom of the washing temperature 117*b*, the rinsing frequency 117*c*, the dehydration strength 117*d*, and the additional function 117*e* displayed on the display 115.

Inside the lower side of the tub 20, a heater 40 for heating water in the tub 20, and a water level sensor (not shown) is installed to detect a frequency that changes according to the water level in order to detect the amount of water (water level) in the drum 30.

In addition, a turbidity sensor 120 for detecting turbidity of water in the tub 20 may be provided inside the lower side of the tub 20. Through this, the turbidity sensor 120 may detect a degree of turbidity due to suspended substances (e.g., detergent, etc.) in the water of the tub 20.

To this end, the turbidity sensor 120 may be a previously known type of turbidity sensor. For example, a light transmission/reception type sensor that detects turbidity according to light reception and a current detection type sensor that detects turbidity according to current detection may be applied.

For example, when the turbidity sensor 120 corresponds to a light transmission/reception type sensor, it includes a light emitting unit that irradiates light to the tub 20 and a light receiving unit that receives light that has passed through the water of the tub 20. In this case, the turbidity sensor 120 may measure the turbidity in the tub 20 based on the amount of light received based on the characteristics of light scattered by the floating object, that is, the light reception degree.

In other words, the turbidity sensor 120 may measure the degree of turbidity of water in the tub 20 from the difference between the amount of light emitted by the light emitting unit and the amount of light received by the light receiving unit. In this case, the turbidity sensor 120 may output a voltage according to the amount of light received from the light receiving unit, and may output a lower voltage as the turbidity increases based on the maximum output voltage (e.g., 4V).

A water supplier 150 for supplying water to the tub 20 is installed on the inner upper part of the main body 10.

The water supplier 150 includes a first water supply pipe 151 connected to an external water supply unit (not shown), a water supply valve 152 that opens and closes the first water supply pipe 151, a detergent supply device, or detergent supplier, 153 for mixing with detergent or softener in water supplied through the first water supply pipe 151, and a second water supply pipe 154 that connects the detergent supply device 153 and the tub 20 to guide the washing water mixed with water and detergent or the rinsing water mixed with water and softener to the tub 20.

At this time, the detergent supply device 153 may be divided into a detergent storage space and a softener storage space, and the first water supply pipe 151 may be provided with one water supply pipe connected to the detergent storage space and another water supply pipe connected to the softener storage space.

A motor 160 for rotating the drum 30 is provided on the rear outer surface of the tub 20. The motor 160 includes a stator 161 installed on the tub 20, a rotor 162 that rotates while interacting with the stator 161, and rotation shaft that one end is installed on the rotor 162 and the other end penetrates the rear of the tub 20 and is installed on the drum 30 to rotate together with the rotor 162 and a rotation shaft 163 that allows the drum 30 to rotate.

A pump 170 for sucking water stored in the tub 20 is installed at an inner lower portion of the main body 10.

The pump 170 is connected to a plurality of pipes. The plurality of pumps includes a first drain pipe 171 connected to the drain port 32 of the tub 20, a second drainage pipe 172 for pumping water sucked from the tub 20 and discharging it to the outside of the main body 10, a connection hose 173 connected to the circulation bubble device 180 so that the water sucked from the tub 20 is resupplied to the tub 20.

In addition, a circulation bubble device, or bubble circulator, 180 is provided under the tub 20 that performing a circulation operation of circulating water in the tub 20 to resupply to the tub 20 or a bubble supplying operation of generating bubbles and supplying them to the tub 20.

The circulation bubble device 180 are respectively connected to a connection hose 173 connected to the pump 170 to receive water from the pump 170, and a connection pipes 50 are connected to the top of the tub 20 so that air can be transmitted from the tub 20. At this time, one end of the connection pipe 50 is connected to the circulation bubble device 180, and the other end of the connection pipe 50 is connected to the tub 20 and is disposed at a position higher than the level of water contained in the tub 20 so that air inside the tub 20 can be sucked. Accordingly, the water delivered from the pump 170 and the air delivered through the connection pipe 50 are mixed in the circulation bubble device 180 to generate a bubble, and the generated bubble is supplied to the tub 20.

At this time, the circulation bubble device 180 is selectively form any one of a bubble supply passage that generates bubbles by mixing air with water delivered from the pump 170 and supplies the generated bubbles to the tub 20, and a circulation passage that guides water to the connection pipe 50 so that the water is circulated through the connection pipe 50. This will be described in detail later.

In addition, the washing machine 1 may include a storage 130 for storing various types of information necessary for control and a controller 140 for controlling the washing machine 1.

The storage 130 according to an embodiment may store information on the operation contents of each course, and a known type of storage medium may be used.

The controller 140 according to an embodiment may control the washing machine 1 to perform the softener course when receiving a softener course from a user through input 110.

At this time, the softener course is a rinsing cycle course that can increase the adsorption rate of the softener, determines whether or not to add the softener based on the turbidity of the water contained in the tub 20 during the rinsing cycle, and is a course in which a rinsing cycle is performed by circulating water inside the tub 20 while providing bubbles into the tub 20 when the softener is injected.

Depending on the embodiment, whether or not to execute this softener course may be predetermined based on the washing mode, and as described above, the user may select whether or not to execute the softener course through input 110.

When performing the softener course, the controller 140 performs a first rinsing cycle when the turbidity of the water of the tub 20 is higher than the first reference value, and the controller 140 controls the water supplier 150 so that water containing a softener is supplied to the tub 20, and performs a second rinsing cycle by controlling the circulation bubble device 180 to alternately perform the circulation operation and the bubble supply operation when the turbidity of the water in the tub 20 is lower than the first reference value.

Specifically, when a softener course is started, the controller 140 may perform a first rinsing cycle in which rinsing is performed by providing rinsing water without a softener. That is, the controller 140 may control the water supplier 150 and the motor 160 to perform the first rinsing cycle.

At this time, when the water supply for the first rinsing cycle is performed, the controller 140 determines the turbidity of water supplied to the tub 20 as a reference turbidity value. Also, the controller 140 determines the first reference value, which is the standard for the start of the second rinsing cycle when the first rinsing cycle is completed and a second reference value that is a criterion for starting the bubble reduction cycle when the second rinsing cycle is completed based on the reference turbidity value.

That is, the controller 140 may adaptively set the reference values by reflecting the turbidity of supplied water by determining the turbidity of the rinsing water immediately before rinsing as the reference turbidity value during the initial first rinsing cycle. In other words, the controller 140 may calibrate the reference turbidity value based on the turbidity of the supplied water.

In this case, the first reference value and the second reference value may be set to a value equal to or greater than a preset ratio compared with the reference turbidity value corresponding to the initial turbidity value of the rinsing water, and may be set to the same or different values according to the design.

For example, the controller 140 may determine the turbidity value of the rinsing water based on a digital conversion value (ADC value) according to the output voltage of the turbidity sensor 120. In this case, based on the maximum digital conversion value (e.g., 820) corresponding to the maximum output voltage (e.g., 4V) of the turbidity sensor 120, correlation information between the output voltage of the turbidity sensor 120 and the digital conversion value may be stored in storage 130, and the output voltage and digital conversion value of the turbidity sensor 120 may be in inverse proportion to the turbidity. In this case, the controller 140 may determine the turbidity of water in the tub 20 corresponds to the first reference value, when the output voltage corresponding to the first reference digital conversion value (e.g., 650) is output through the turbidity sensor 120. When the output voltage corresponding to the second reference digital conversion value (e.g. 700) is output through the turbidity sensor 120, the controller 140 may determine the turbidity of water in the tub 20 corresponds to the second reference value. For example, the first reference value and the second reference value may correspond to nephelometric turbidity units (NTUs) between 2 and 3, and the second reference value may be set to a lower value than the first reference value.

Thereafter, when the first rinsing cycle is completed, the controller 140 may compare the turbidity of the water of the tub 20 with the first reference value, and when the turbidity of water of the tub 20 is lower than the first reference value, the controller 140 may perform a second rinsing cycle in which rinsing is performed by providing rinsing water including a softener.

At this time, the controller 140 may control the water supplier 150 and the motor 160 to perform the first rinsing cycle again after controlling the pump 170 to proceed with drainage when the turbidity of the water in the tub 20 is higher than the first reference value.

That is, the controller 140 may determine whether to perform the second rinsing cycle based on the turbidity of the rinsing water immediately before draining the rinsing water of the tub 20 after the first rinsing cycle is completed. The second rinsing cycle corresponds to the last rinsing cycle in the softener course.

In this way, the washing machine 1 detects the turbidity of the rinsing water in the first rinsing cycle and initiates the second rinsing cycle that the rinsing water containing the softener to perform rinsing only when the turbidity is lower than the first reference value, so that a softener can be provided in a clean state from which residual detergent has been removed and the softener can be diluted more efficiently in the rinsing water. Through this, the washing machine 1 can increase the adsorption rate of the softener to laundry.

In addition, when starting the second rinsing cycle, the controller 140 generates a circulation operation and bubbles of circulating water in the tub 20 and resupplying it to the tub 20. And the circulation bubble device 180 may be controlled to alternately perform the bubble supply operation supplied to the tub 20.

At this time, circulation bubble device 180 may selectively foam a circulation passage for resupplying water discharged from the pump 170 to the tub 20, and bubble supply passage that generates bubbles in the water discharged from the pump 170 and supplies them to the tub 20.

That is, the circulation bubble device 180 may include a switching member, or switch, for selectively forming a circulation passage or a bubble supply passage, and may include a driving device for driving the switching member.

That is, when starting the second rinsing cycle, the controller 140 may control the driving device so that water discharged from the pump 170 alternately passes through the circulation passage and the bubble supply passage.

In this way, when performing the second rinsing cycle, the washing machine 1 circulates the water in the tub 20 so that the water discharged from the tub 20 is resupplied to the tub 20, so that the softener is applied to the rinsing water to be diluted more effectively, and provides a bubble in the tub 20 so that the softener can be more efficiently applied to the laundry. Through this, the washing machine 1 can increase the adsorption rate of the softener to laundry.

When the second rinsing cycle is completed, the controller 140 according to an embodiment compares the turbidity of the water of the tub 20 with a second reference value, and may perform a bubble reduction cycle when the turbidity of the water in the tub 20 is higher than the second reference value.

The controller 140 may stop each operation of the water supplier 150, the motor 160, the pump 170, and the circulation bubble device 180 so that bubbles no longer occur and can be removed naturally when the turbidity of the rinsing water is lower than the second reference value when it is determined that the turbidity of the rinsing water is high after the second rinsing cycle.

For example, the controller 140 does not operate each component of the washing machine 1 (e.g., water supplier 150, motor 160, pump 170, circulation bubble device 180, etc.) for a preset time (e.g., 20 seconds) when performing a bubble reduction cycle.

As such, the washing machine 1 may increase the user's reliability for the rinsing cycle by allowing bubbles that may remain after the second rinsing cycle to be naturally removed. In other words, by performing the bubble reduction cycle, the washing machine 1 can improve user reliability by preventing the user from mistaken for rinsing that the rinsing has not been properly performed when bubbles remain after the rinsing cycle.

The controller 140 according to an embodiment may control the pump 170 so that water contained in the tub 20 is discharged to the outside, and then control the motor 160 to perform a dehydration cycle when the turbidity of the rinsing water after the second rinsing cycle is lower than the second reference value.

The controller 140 may include at least one memory storing a program for performing the operations described above and an operation described later, and at least one processor executing the stored program.

In the above, each configuration of the washing machine 1 has been described in detail. Hereinafter, a case in which the circulation bubble device 180 operating during the second rinsing cycle performs a circulation operation or a bubble supply operation will be described in detail.

Figure 5:
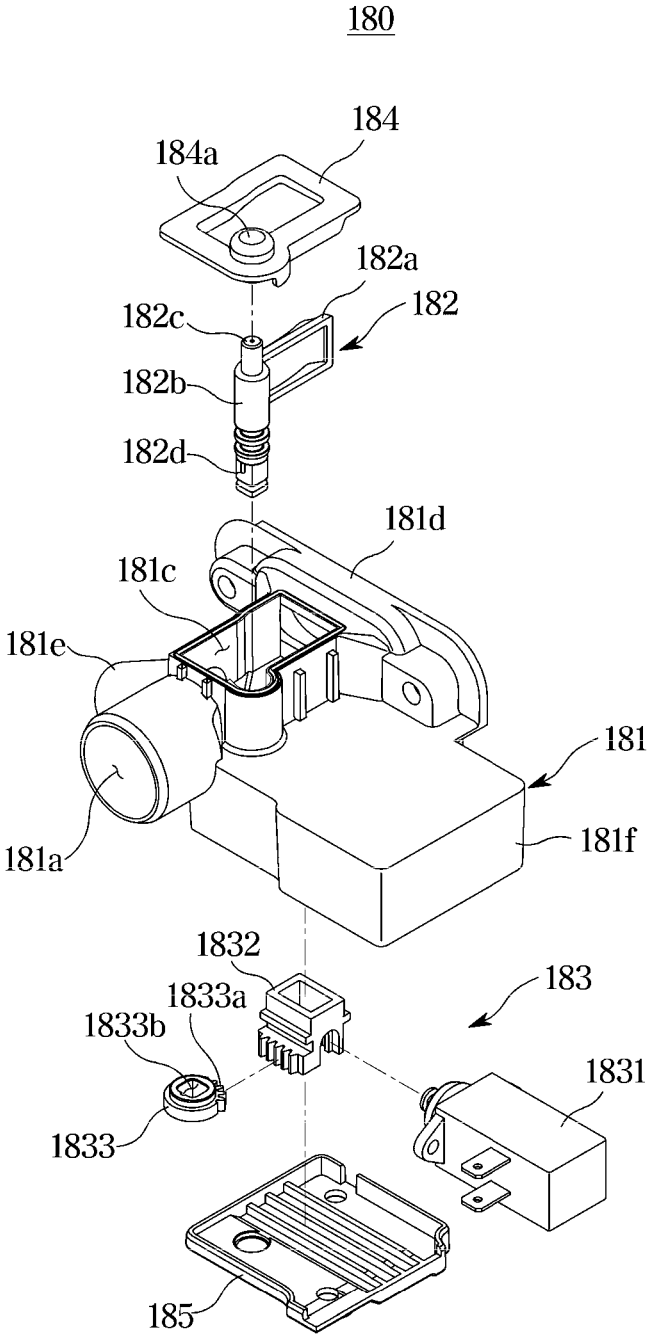
FIG. 5 is an exploded perspective view of a circulation bubble device according to an embodiment of the disclosure.
Figure 6:
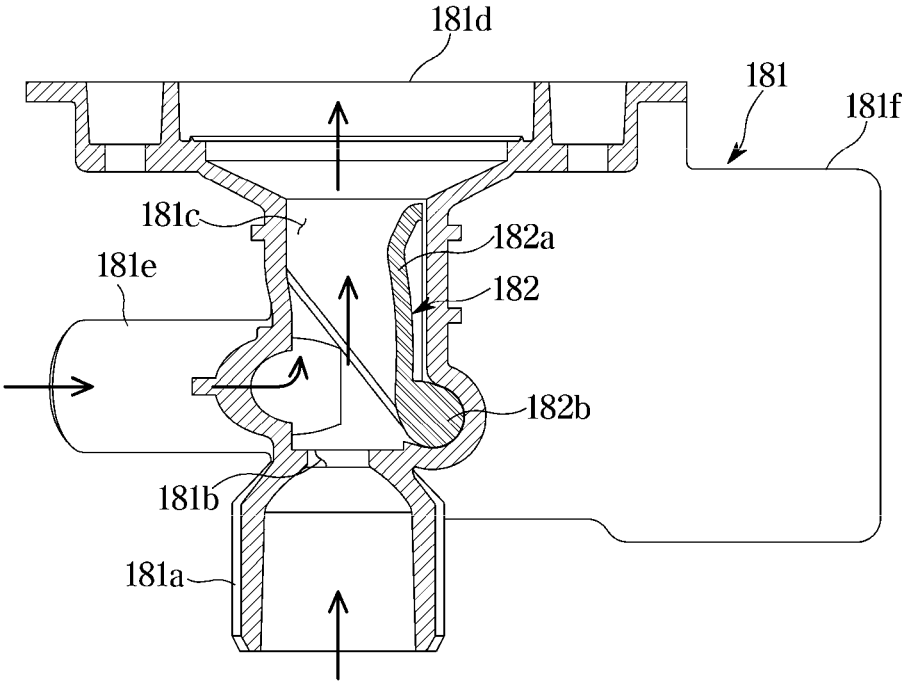
FIGS. 6 and 7 are diagrams illustrating the operation of the circulation bubble device applied to the washing machine according to an embodiment of the disclosure.
Figure 7:
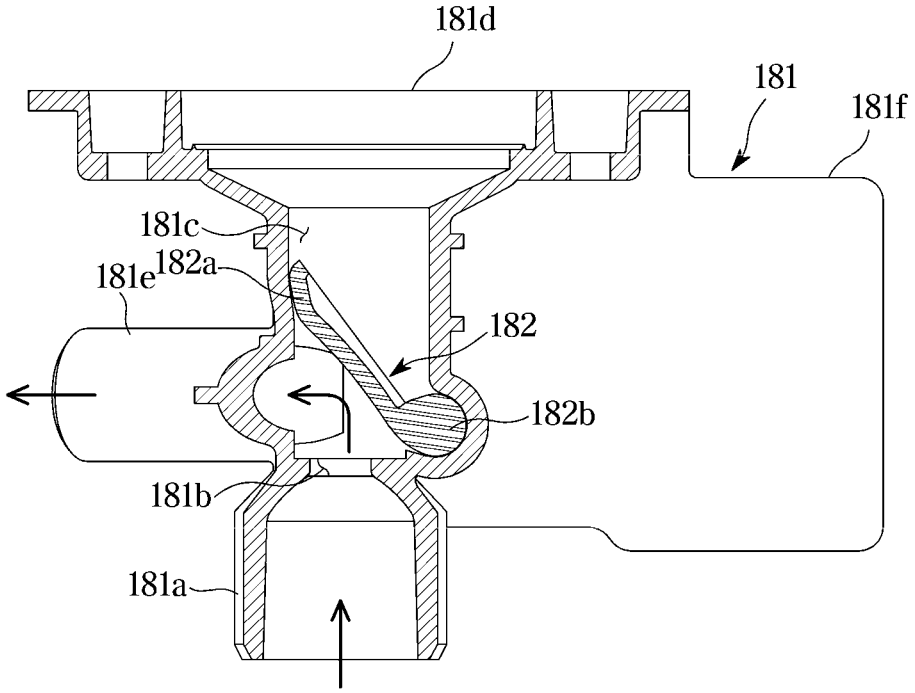

FIG. 5 is an exploded perspective view of a circulation bubble device according to an embodiment of the disclosure. FIGS. 6 and 7 are diagrams illustrating the operation of the circulation bubble device applied to the washing machine according to an embodiment of the disclosure.

Referring to FIG. 5, the circulation bubble device 180 includes a housing 181 forming an external shape, a bubble supply passage disposed inside the housing 181 to generate bubbles, a switching member 182 for selectively forming a circulation passage for circulating the rinsing water in the tub 20, and a driver 183 for driving the switching member 182.

The housing 181 includes a first connection port 181*a* to which the connection hose 173 is connected and provided with an orifice portion 181*b* having a reduced diameter (see FIGS. 6 and 7), a second connection port 181*d* connected to the tub 20 provided in a moving direction of the washing water passing through the orifice portion 181*b* with respect to the first connection port 181*a*, a switching channel 181*c* disposed between the first connection port 181*a* and the second connection port 181*d* to connect the first connection port 181*a* and the second connection port 181*d*, and a third connection port connected to the switching channel 181*c* so as to be inclined with respect to the direction of movement of the rinsing water, and through which air from the tub 20 flows in or discharges the rinsing water through the connection pipe 50 (181*e*).

At this time, the upper side of the switching channel 181*c* of the housing 181 is open for installation of the switching member 182, and the housing 181 is provided with a first cover 184 for closing the upper side of the switching channel 181*c*. In addition, a driving unit 181*f* on which the above-described driver 183 is installed is provided under the housing 181. The driving part 181*f* is opened downward to install the driver 183, and a second cover 185 for covering the lower side of the opened driving unit 181*f* is installed in the housing 181.

The switching member 182 rotates and allows the rinsing water delivered through the first connection port 181*a* to be delivered to one of the second connection port 181*d* and the second connection port 181*d*.

The switching member 182 includes an opening/closing part 182*a* for opening and closing the switching channel 181*c*, a shaft portion 182*b* provided on one side of the opening/closing part 182*a* so that the switching member 182 can be rotatably installed in the switching channel 181*c*, a connection portion 182*d* provided in a polygonal shape at the bottom of the shaft portion 182*b* and connected to the pinion 1833 so that the switching member 182 rotates with the pinion (1833), and a hinge protrusion 182*c* portion provided on the upper end of the shaft portion 182*b* so that the switching member 182 can be rotatably installed on the hinge portion 184*a* provided in the first cover 184.

The driver 183 includes an actuator 1831, the rack 1832 moved by the actuator 1831, and a pinion 1833 which is interdigitated with the rack 1832 rotates according to the movement of the rack 1832. The pinion 1833 includes a rack 1832 and a plurality of teeth 1833*a* interdigitated, and a connection hole 1833*b* formed in a polygonal shape to correspond to the connection portion 182*d* of the switching member 182 described above. However, the driver 183 is not limited to the above example, and may be provided with a motor according to embodiments. That is, the pinion 1833 can also be rotated by the motor of the driver 183.

Referring to FIG. 6, the circulation bubble device 180 may receive water contained in the tub 20 from the pump 170 through a connection hose 173 in the case of performing a circulation operation of circulating water in the tub 20 and resupplying it to the tub 20 during the second rinsing cycle.

In this case, the circulation bubble device 180 may control the driver 183 to close the switching channel 181*c*, and the rack 1832 moves by the operation of the actuator 1831, and the pinion 1833 rotates according to the movement of the rack 1832. Since the switching member 182 is connected to the pinion 1833 through the connection portion 182*d*, it rotates together with the pinion 1833, so that the opening/closing portion 182*a* of the switching member 182 closes the middle of the switching channel 181*c*.

The rinsing water delivered through the first connection port 181*a* connected to the connection hose 173 in the closed state of the switching channel 181*c* is guided to the connection pipe 50 through the third connection port 71*e*, and it is discharged from the top of the tub 20 through the connection pipe 50.

In this way, circulation passage is formed by the circulation bubble device 180, the rinsing water of the tub 20 is sucked by the pump 170 and then delivered to the circulation bubble device 180 through the connection hose 173, and the rinsing water is circulated because it is transferred from the circulation bubble device 180 to the inside of the tub 20 through the connection pipe 50.

Referring to FIG. 7, the circulation bubble device 180 may receive water contained in the tub 20 from the pump 170 through a connection hose 173 when performing a bubble supply operation of generating bubbles and supplying them to the tub 20 during the second rinsing cycle.

In this case, the circulation bubble device 180 may control the driver 183 to open the switching channel 181*c*, and in this state, since the rinsing water that has passed through the orifice portion 181*b* passes through the switching channel 181*c* at a high speed, according to Bernoulli's law, the pressure inside the switching channel 181*c* is lowered. When the pressure inside the conversion channel 181*c* is lower than the atmospheric pressure, air is sucked from the tub 20 into the switching channel 181*c* through the connection pipe 50 connected to the third connection port 181*e*. Bubbles are generated by mixing the rinsing water and air in the conversion passage 181*c*, and the generated bubbles are supplied to the tub 20 through the third connection port 181*e*.

In this way, the bubble supply passage is formed by the circulation bubble device 180 so that the rinsing water of the tub 20 is sucked by the pump 170 and then transferred to the circulation bubble device 180 through the connection hose 173, and the air inside the tub 20 is sucked into the circulation bubble device 180 through the connection pipe 50 and mixed with the rinsing water delivered from the pump 170, and bubbles are generated in the circulation bubble device 180. At this time, the bubble generated in the circulation bubble device 180 is supplied to the tub 20.

In the above, the air introduced through the connection pipe 50 is mixed with the rinsing water delivered from the pump 170 to generate bubbles, but is not limited thereto. A separate air inlet pipe (not shown) may be provided in the circulation bubble device 180, and the operation of generating bubbles by mixing air introduced through the air inlet pipe with the rinsing water delivered from the pump 170 may be performed.

The operation of the circulation bubble device 180 in the second rinsing cycle has been described in detail. Hereinafter, a case in which the washing machine 1 performs a softener course will be described in detail.

Figure 8:
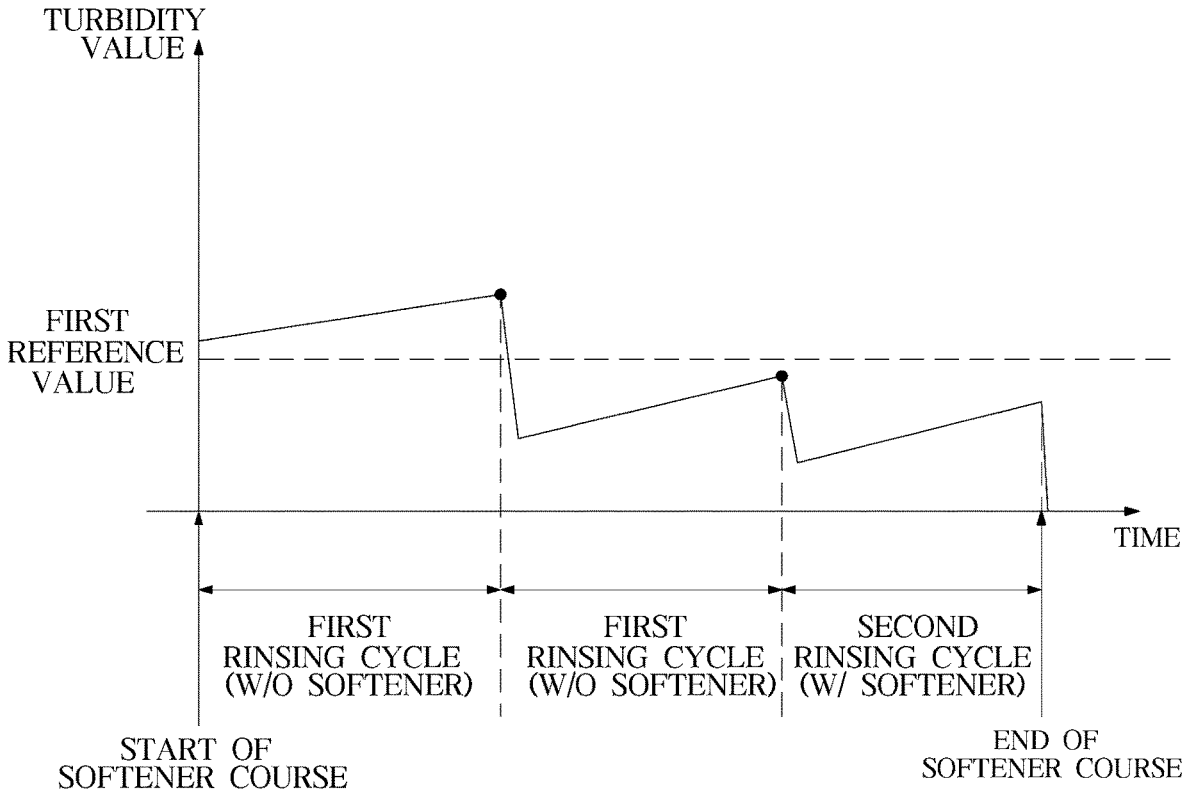
FIG. 8 is a diagram illustrating a case in which a washing machine according to an embodiment of the disclosure performs a softener course.
Figure 9:
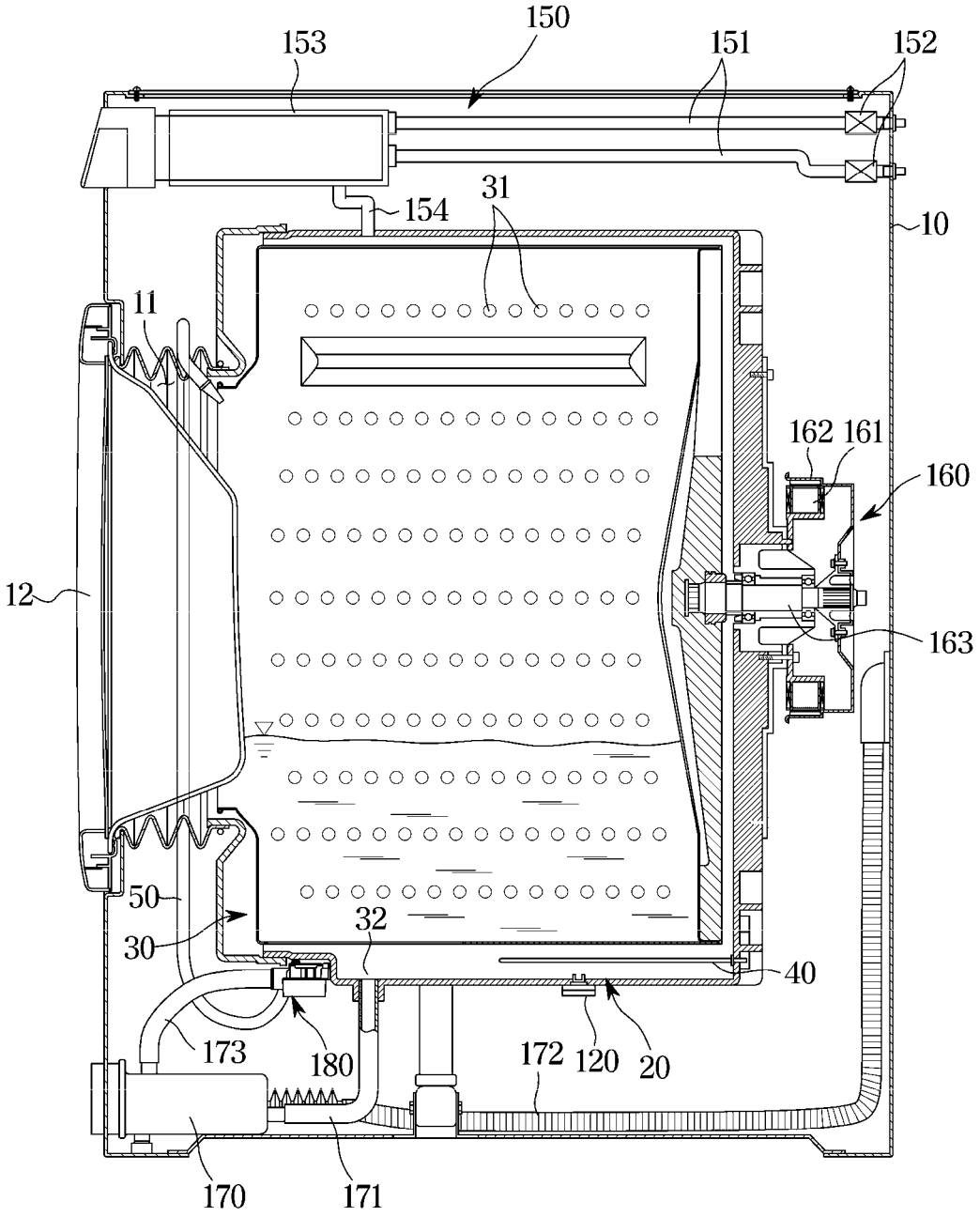
FIG. 9 is a diagram illustrating a case in which a washing machine according to an embodiment of the disclosure performs a first rinsing cycle.
Figure 10:
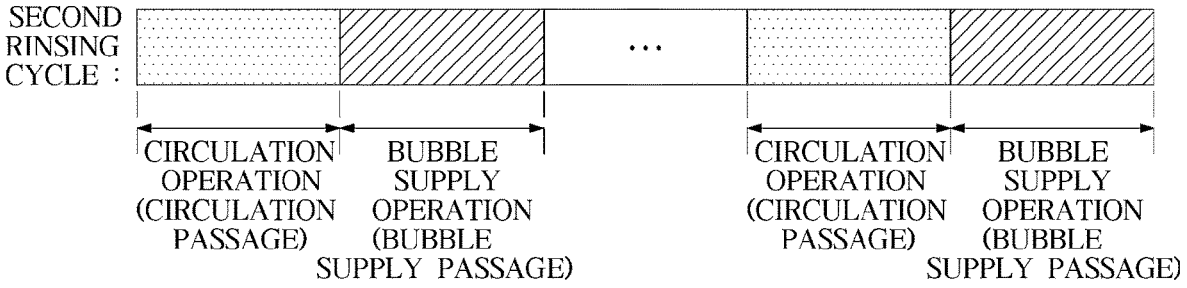
FIG. 10 is a diagram illustrating an operation in a second rinsing cycle of a washing machine according to an embodiment of the disclosure.
Figure 11:
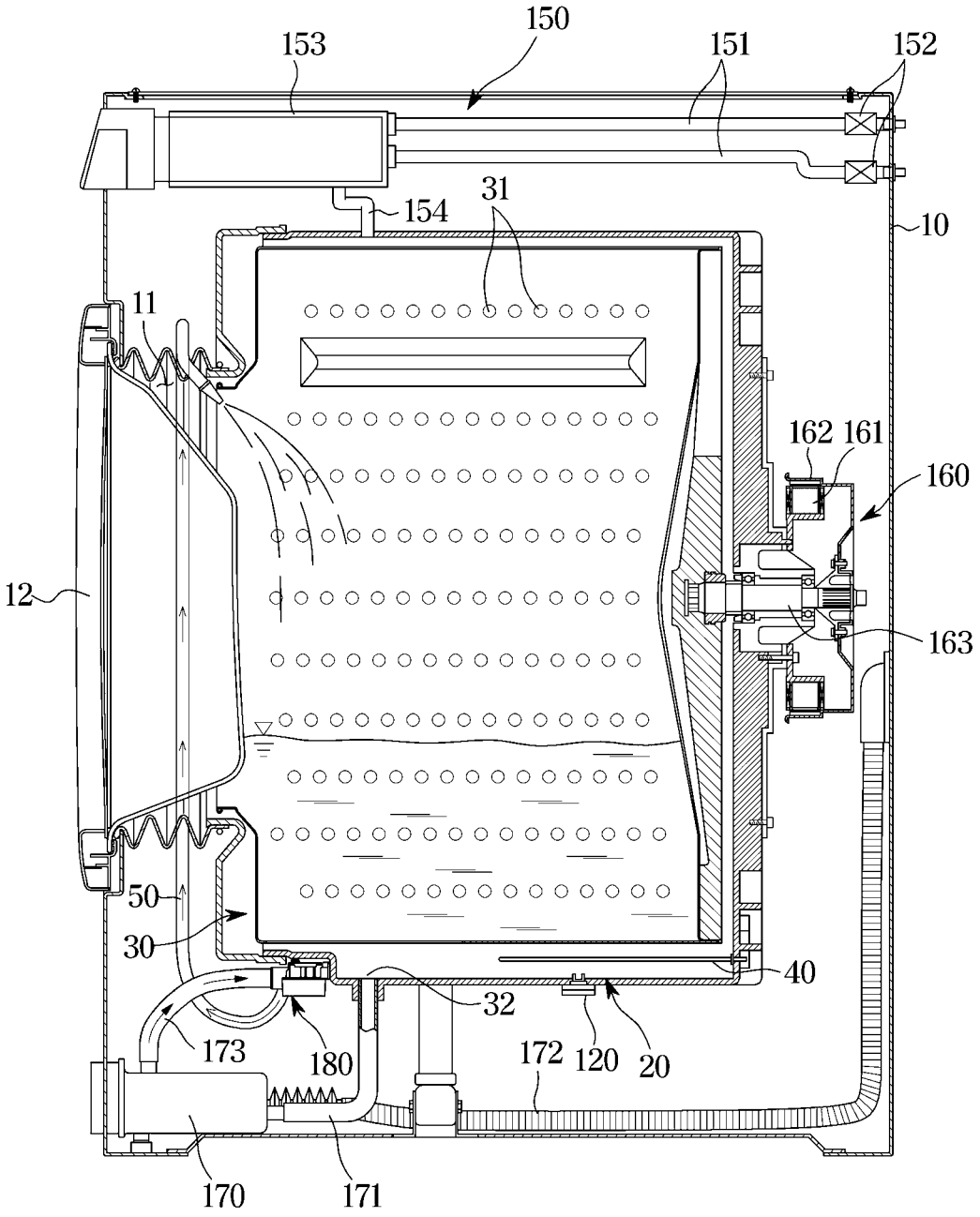
FIGS. 11 and 12 are diagrams illustrating a case in which a washing machine according to an embodiment of the disclosure performs a second rinsing cycle.
Figure 12:
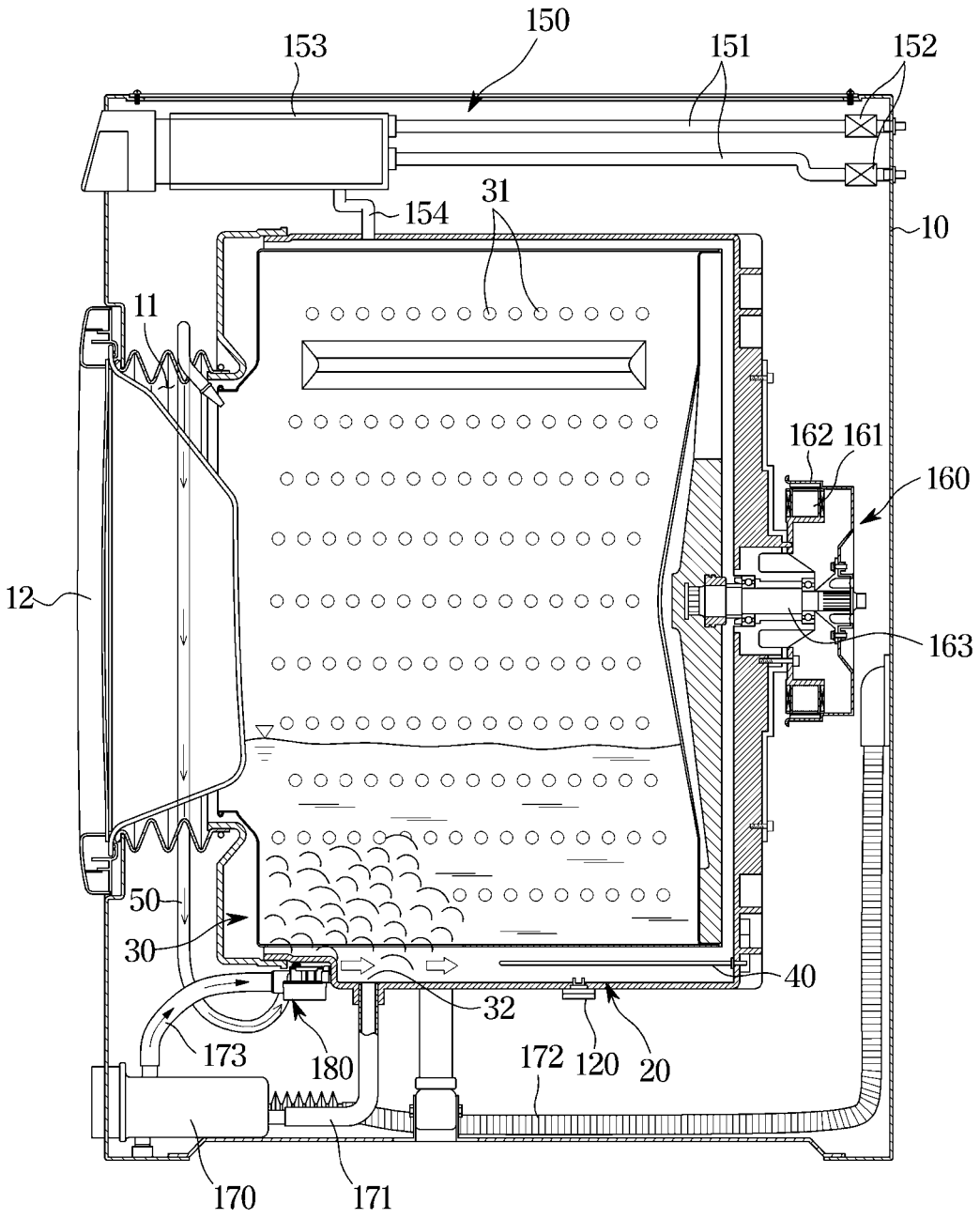

FIG. 8 is a diagram illustrating a case in which a washing machine according to an embodiment of the disclosure performs a softener course. FIG. 9 is a diagram illustrating a case in which a washing machine according to an embodiment of the disclosure performs a first rinsing cycle. FIG. 10 is a diagram illustrating an operation in a second rinsing cycle of a washing machine according to an embodiment of the disclosure. FIGS. 11 and 12 are diagrams illustrating a case in which a washing machine according to an embodiment of the disclosure performs a second rinsing cycle.

Referring to FIG. 8 and FIG. 9, when the softener course is started, the controller 140 may perform a first rinsing cycle in which rinsing is performed by providing rinsing water not including the softener. That is, the controller 140 may control the water supplier 150 and the motor 160 to perform the first rinsing cycle.

At this time, when water supply for the first rinsing cycle is performed, the controller 140 determines the turbidity of water supplied to the tub 20 as a reference turbidity value based on the output of the turbidity sensor 120, Also, the controller 140 determines a first reference value that is a reference for starting a second rinsing cycle when the first rinsing cycle is completed and a second reference value that is a reference for starting a bubble reduction cycle when the second rinsing cycle is completed based on the reference turbidity value.

That is, the controller 140 may adaptively set the reference values by reflecting the turbidity of supplied water by determining the turbidity of the rinsing water immediately before rinsing as the reference turbidity value during the initial first rinsing cycle. In other words, the controller 140 may calibrate the reference turbidity value based on the turbidity of the supplied water.

In this case, the first reference value and the second reference value may be set to a value equal to or greater than a preset ratio compared with the reference turbidity value corresponding to the initial turbidity value of the rinsing water, and may be set to the same or different values according to the design.

Thereafter, when the first rinsing cycle is completed, the controller 140 may compare the turbidity of the water of the tub 20 with the first reference value, and when the turbidity of the water of the tub 20 is lower than the first reference value, the controller 140 may perform a second rinsing cycle in which rinsing is performed by providing rinsing water including a softener.

At this time, the controller 140 may control the water supplier 150 and the motor 160 to perform the first rinsing cycle again after controlling the pump 170 to proceed with drainage when the turbidity of the water in the tub 20 is higher than the first reference value.

That is, the controller 140 may determine whether to perform the second rinsing cycle based on the turbidity of the rinsing water immediately before draining the rinsing water of the tub 20 after the first rinsing cycle is completed. The second rinsing cycle corresponds to the last rinsing cycle in the softener course.

For example, as shown in FIG. 8, the controller 140 may perform a first rinsing cycle once, for providing rinsing water without a softener, after the softener course is started, and may perform the first rinsing cycle once again if the turbidity after completion of the first rinsing cycle is greater than or equal to the first reference value. At this time, when determining that the turbidity after completion of the two first rinsing cycles is less than or equal to the first reference value, the controller 140 may start a second rinsing cycle that provides rinsing water including a softener.

In this way, the washing machine 1 detects the turbidity of the rinsing water in the first rinsing cycle and initiates the second rinsing cycle that the rinsing water containing the softener to perform rinsing only when the turbidity is lower than the first reference value, so that a softener can be provided in a clean state from which residual detergent has been removed and the softener can be diluted more efficiently in the rinsing water. Through this, the washing machine 1 can increase the adsorption rate of the softener to laundry.

In addition, when starting the second rinsing cycle, the controller 140 generates a circulation operation and bubbles of circulating water in the tub 20 and resupplying it to the tub 20. And the circulation bubble device 180 may be controlled to alternately perform the bubble supply operation supplied to the tub 20.

That is, as shown in FIG. 10, in the second rinsing cycle, a circulation operation in which a circulation passage is formed to circulate water in the tub 20 and resupply it to the tub 20 and a bubble supply operation of forming a bubble supply passage to generate bubbles and supplying them to the tub 20 can be done alternately.

At this time, circulation bubble device 180 may selectively foam a circulation passage for resupplying water discharged from the pump 170 to the tub 20, and bubble supply passage that generates bubbles in the water discharged from the pump 170 and supplies them to the tub 20.

That is, the circulation bubble device 180 may include a switching member for selectively forming a circulation passage or a bubble supply passage, and may include a driver for driving the switching member 183.

That is, when starting the second rinsing cycle, the controller 140 may control the driving device so that water discharged from the pump 170 alternately passes through the circulation passage and the bubble supply passage.

When starting the second rinsing cycle, the controller 140 may control the driver 183 so that water discharged from the pump 170 alternately passes through the circulation passage and the bubble supply passage.

Specifically, when starting the second rinsing cycle, the controller 140 may control the driver 183 to perform a circulation operation of circulating water discharged from the pump 170 and resupplying it to the tub 20, and in this case, as shown in FIG. 11, the rinsing water is resupplied from the top of the tub 20 through the connection pipe 50.

In this way, a circulation passage is formed by the circulation bubble device 180 so that the rinsing water of the tub 20 is sucked by the pump 170 and then transferred to the circulation bubble device 180 through the connection hose 173, and the rinsing water of the tub 20 is circulated because it is transferred from the circulation bubble device 180 to the inside of the tub 20 through the connection pipe 50.

In addition, when starting the second rinsing cycle, the controller 140 may control the driver 183 to perform a bubble supply operation of generating bubbles and supplying them to the tub 20, and in this case, as shown in FIG. 12, bubbles generated in the circulation bubble device 180 are supplied to the tub 20.

In this way, the bubble supply passage is formed by the circulation bubble device 180 so that the rinsing water of the tub 20 is sucked by the pump 170 and then transferred to the circulation bubble device 180 through the connection hose 173, and the air inside the tub 20 is sucked into the circulation bubble device 180 through the connection pipe 50 and mixed with the rinsing water delivered from the pump 170, and bubbles are generated in the circulation bubble device 180.

In this way, when performing the second rinsing cycle, the washing machine 1 circulates the water in the tub 20 so that the water discharged from the tub 20 is resupplied to the tub 20, so that the softener is more effectively diluted with the rinsing water, and bubbles into the tub 20. Therefore, the softener can be applied more efficiently to the laundry. Through this, the washing machine 1 can increase the adsorption rate of the softener to laundry.

Figure 13:
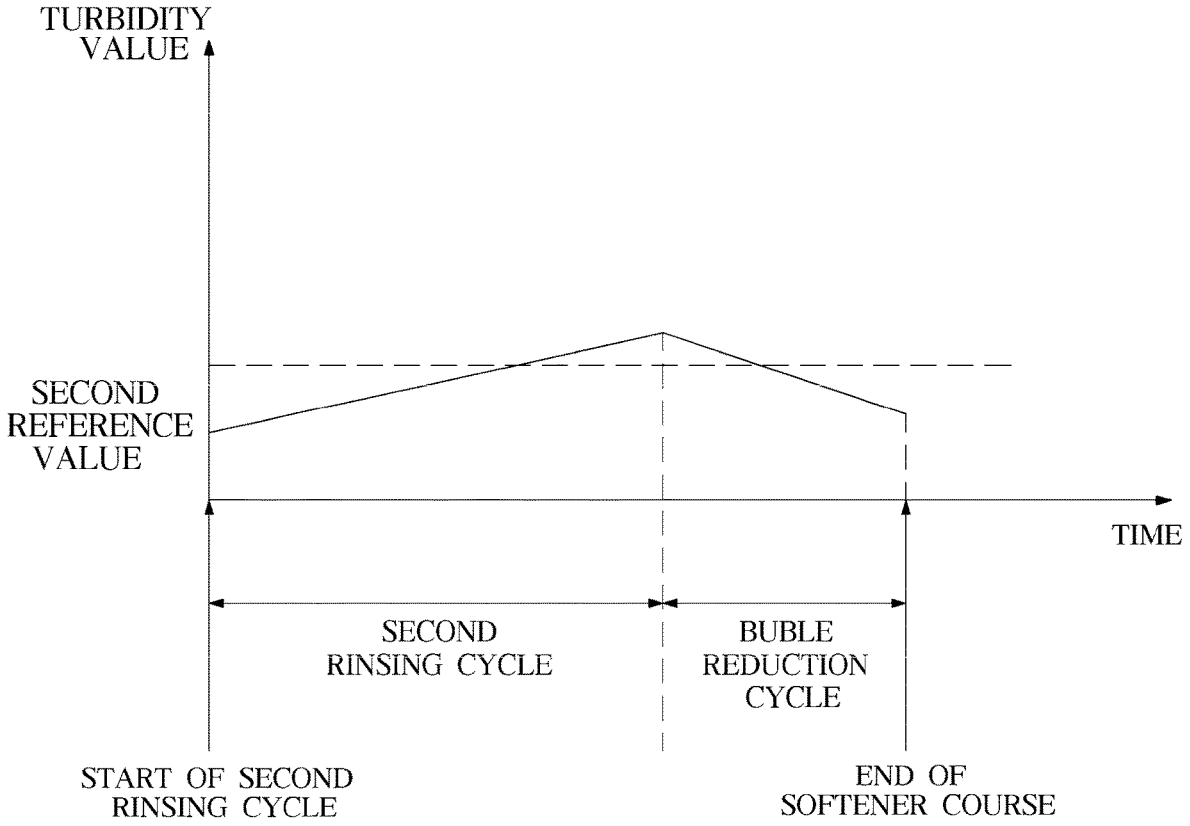
FIG. 13 is a diagram illustrating a case in which a washing machine according to an embodiment of the disclosure performs a bubble reduction cycle.

FIG. 13 is a diagram illustrating a case in which a washing machine according to an embodiment of the disclosure performs a bubble reduction cycle.

Referring to FIG. 13, when the second rinsing cycle is completed, the controller 140 according to an embodiment compares the turbidity of water of the tub 20 with a second reference value, and performs a bubble reduction cycle when the turbidity of the water in the tub 20 is higher than the second reference value.

That is, the controller 140 may stop performing the operation of the water supplier 150, the motor 160, the pump 170, and the circulation bubble device 180 when it is determined that the turbidity of the rinsing water is high after the second rinsing cycle, so that bubbles no longer occur and can be removed naturally, so that the turbidity of the rinsing water is lower than a second reference value.

For example, the controller 140 controls each component of the washing machine 1 (e.g., water supplier 150, motor 160, pump 170, circulation bubble device 180, etc.) to stop for a preset time (e.g., 20 seconds) when performing a bubble reduction cycle.

As such, the washing machine 1 may increase the user's reliability for the rinsing cycle by allowing bubbles that may remain after the second rinsing cycle to be naturally removed. In other words, by performing the bubble reduction cycle, the washing machine 1 may prevent the user from mistaken for rinsing that the rinsing has not been properly performed when bubbles remain even after the rinsing cycle, and improve user reliability.

The controller 140 according to an embodiment may control the pump 170 so that water contained in the tub 20 is discharged to the outside when the turbidity of the rinsing water after the second rinsing cycle is lower than the second reference value, and may control the motor 160 to perform a dehydration cycle.

Hereinafter, an embodiment of a method for controlling the washing machine 1 according to an aspect will be described. The washing machine 1 according to the above-described embodiment may be used as a control method of the washing machine 1. Accordingly, the contents described above with reference to FIGS. 1 to 13 may be equally applied to the control method of the washing machine 1.

Figure 14:
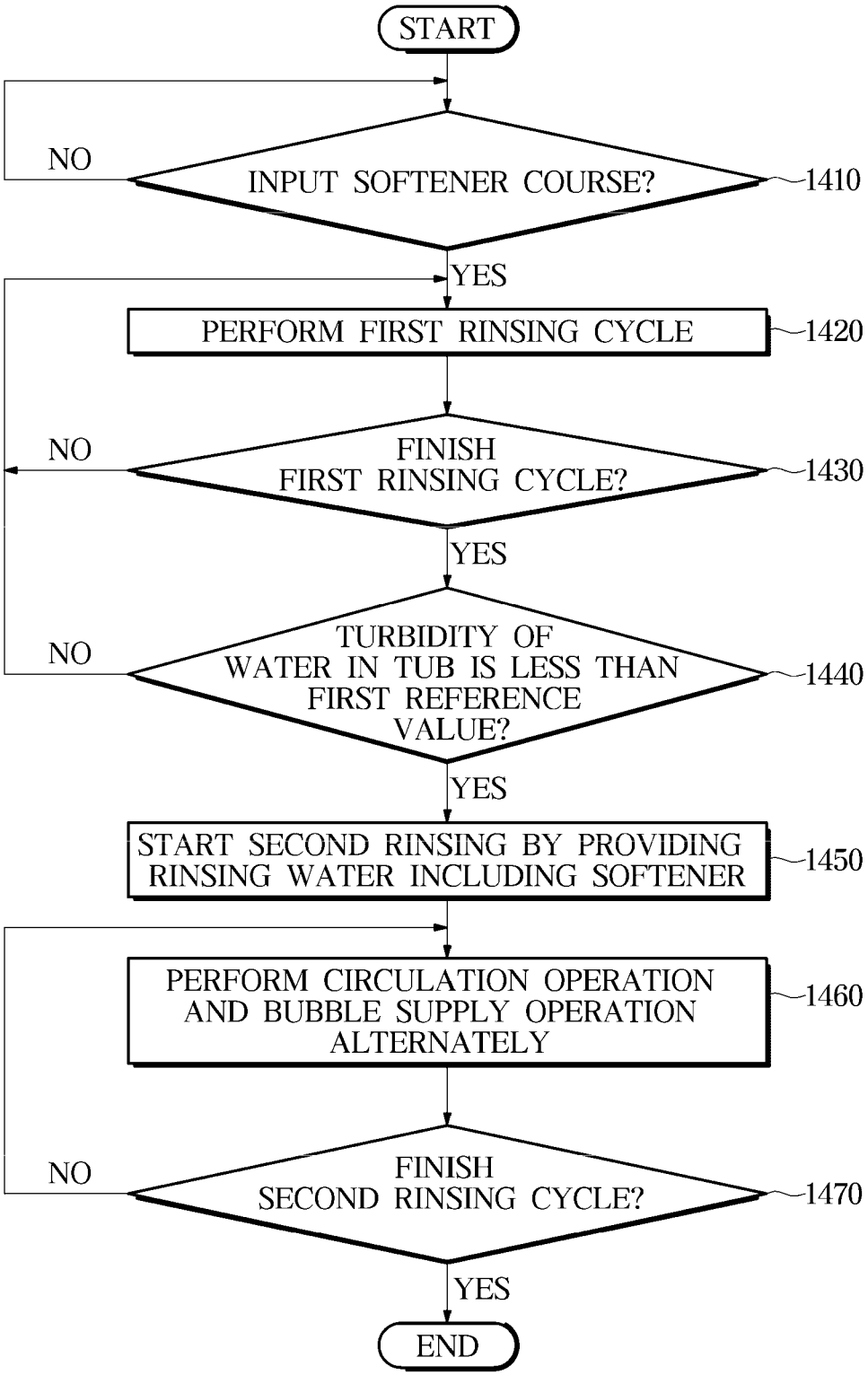
FIG. 14 is a flowchart illustrating a case of performing a first rinsing cycle and a second rinsing cycle in a control method of a washing machine according to an embodiment of the disclosure.

FIG. 14 is a flowchart illustrating a case of performing a first rinsing cycle and a second rinsing cycle in a control method of a washing machine according to an embodiment of the disclosure.

Referring to FIG. 14, when a softener course of the washing machine 1 according to an embodiment is input (1410), a first rinsing cycle may be performed to start the softener course (1420).

Specifically, when a softener course is started, the controller 140 may perform a first rinsing cycle in which rinsing is performed by providing rinsing water without a softener. That is, the controller 140 may control the water supplier 150 and the motor 160 to perform the first rinsing cycle.

At this time, when the water supply for the first rinsing cycle is performed, the controller 140 determines the turbidity of water supplied to the tub 20 as a reference turbidity value, and the controller 140 determines the first reference which is the criterion for the start of the second rinsing cycle and the second reference value that is the criterion for starting the bubble reduction cycle based on the reference turbidity value.

Thereafter, when the first rinsing cycle is completed (YES in 1430), the washing machine 1 may compare the turbidity of water in the tub 20 with the first reference value, and when the turbidity of the water of the tub 20 is lower than the first reference value (YES in 1440), the washing machine 1 may start a second rinsing cycle by providing rinsing water including a softener (1450).

At this time, the washing machine 1 may perform the first rinsing cycle again after controlling the pump 170 to proceed with drainage (1420) when the turbidity of the water in the tub 20 is higher than the first reference value (No in 1440).

That is, the controller 140 may determine whether to perform the second rinsing cycle based on the turbidity of the rinsing water immediately before draining the rinsing water of the tub 20 after the first rinsing cycle is completed. The second rinsing cycle corresponds to the last rinsing cycle in the softener course.

As such, only when the turbidity of the rinsing water in the first rinsing cycle is detected and the turbidity is lower than the first reference value, the washing machine 1 initiates a second rinsing cycle in which rinsing is performed by providing rinsing water containing a softener, so that the softener is provided in a clean state from which residual detergent is removed, so that the softener can be more efficiently diluted with the rinsing water. Through this, the washing machine 1 can increase the adsorption rate of the softener to laundry.

In addition, the washing machine 1 may alternately perform a circulation operation of circulating water in the tub 20 to resupply to the tub 20 and a bubble supplying operation of generating bubbles and supplying them to the tub 20 (1460) when starting the second rinsing cycle.

At this time, circulation bubble device 180 may form a circulation passage for resupplying water discharged from the pump 170 to the tub 20, and a bubble supply passage that generates bubbles in the water discharged from the pump 170 and supplies it to the tub 20 selectively.

That is, the circulation bubble device 180 may include a switching member for selectively forming a circulation passage or a bubble supply passage, and may include a driver for driving the switching member.

That is, when starting the second rinsing cycle, the controller 140 may control the driver so that the water discharged from the pump 170 alternately passes through the circulation passage and the bubble supply passage.

The washing machine 1 according to an embodiment alternately performs a circulation operation and a bubble supply operation when the second rinsing cycle is not completed (No in 1470), and finishes the softener course when the second rinsing cycle is completed (YES in 1470).

That is, the washing machine 1 may alternately perform a circulation operation and a bubble supply operation until the second rinsing cycle is completed.

In this way, when performing the second rinsing cycle, the washing machine 1 circulates the water in the tub 20 so that the water discharged from the tub 20 is resupplied to the tub 20, so that the softener is more effectively diluted with the rinsing water, and bubbles into the tub 20. Therefore, the softener can be applied more efficiently to the laundry. Through this, the washing machine 1 can increase the adsorption rate of the softener to laundry.

Figure 15:
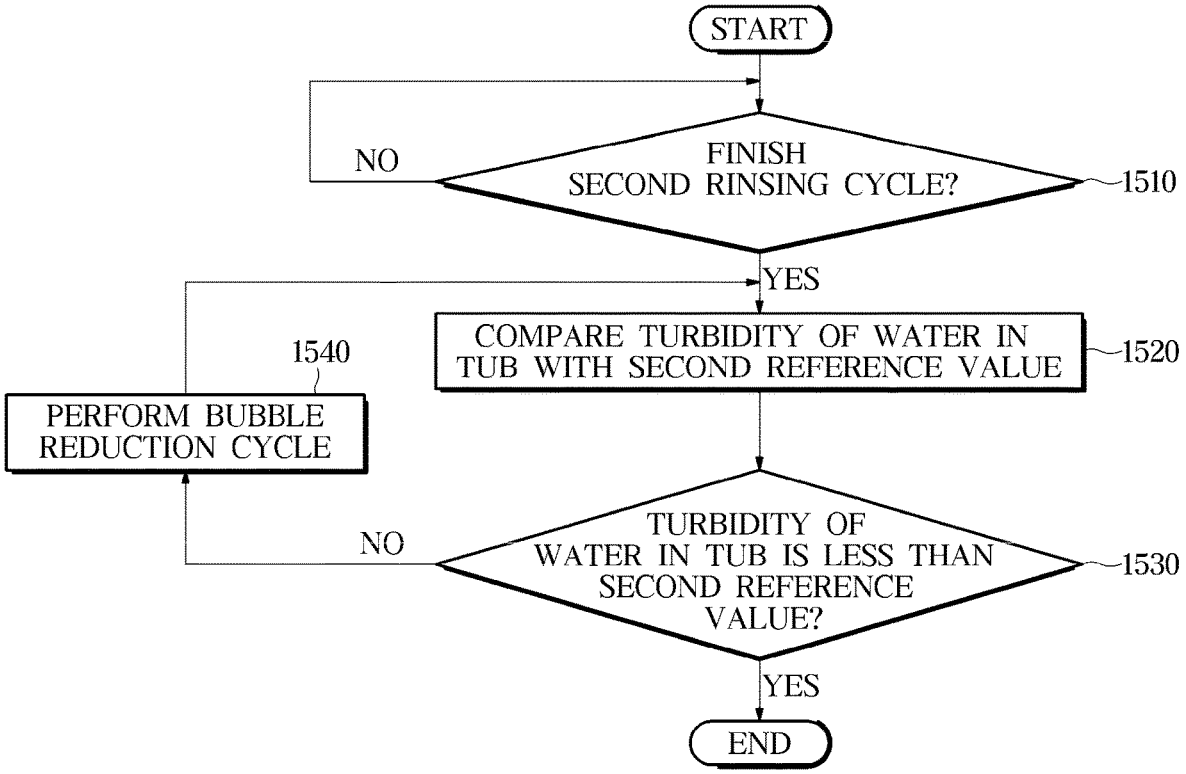
FIG. 15 is a flowchart illustrating a case of performing a bubble reduction cycle in a control method of a washing machine according to an embodiment of the disclosure.

FIG. 15 is a flowchart illustrating a case of performing a bubble reduction cycle in a control method of a washing machine according to an embodiment of the disclosure.

Referring to FIG. 15, when the second rinsing cycle is completed (YES in 1510), the washing machine 1 according to an embodiment compares the turbidity of water in the tub 20 with a second reference value (1520), and when the turbidity of the water in the tub 20 is higher than the second reference value (No in 1530), a bubble reduction cycle may be performed (1540).

That is, the controller 140 may stop performing the operation of the water supplier 150, the motor 160, the pump 170, and the circulation bubble device 180 when it is determined that the turbidity of the rinsing water is high after the second rinsing cycle, so that bubbles no longer occur and can be removed naturally, so that the turbidity of the rinsing water is lower than a second reference value.

For example, the controller 140 controls each component of the washing machine 1 (e.g., water supplier 150, motor 160, pump 170, circulation bubble device 180, etc.) to stop for a preset time (e.g., 20 seconds) when performing a bubble reduction cycle.

As such, the washing machine 1 may increase the user's reliability for the rinsing cycle by allowing bubbles that may remain after the second rinsing cycle to be naturally removed. In other words, by performing the bubble reduction cycle, the washing machine 1 may prevent the user from mistaken for rinsing that the rinsing has not been properly performed when bubbles remain even after the rinsing cycle, and improve user reliability.

The washing machine 1 according to an embodiment may terminate the softener course when the turbidity of the rinsing water is lower than the second reference value after the second rinsing cycle (YES in 1530).

That is, the controller 140 may control the pump 170 so that water contained in the tub 20 is discharged to the outside to end the softener course, and then perform a dehydration cycle when the turbidity of the rinsing water after the second rinse cycle is lower than the second reference value.

Meanwhile, the disclosed embodiments may be implemented in the form of a recording medium storing instructions executable by a computer. Instructions may be stored in the form of program codes, and when executed by a processor, a program module may be generated to perform operations of the disclosed embodiments. The recording medium may be implemented as a computer-readable recording medium.

Computer-readable recording media include all kinds of recording media in which instructions that can be read by a computer are stored. For example, there may be read only memory (ROM), random access memory (RAM), magnetic tape, magnetic disk, flash memory, optical data storage device, and the like.

Although a few embodiments of the disclosure have been shown and described, it would be appreciated by those skilled in the art that changes may be made in these embodiments without departing from the principles and spirit of the disclosure, the scope of which is defined in the claims and their equivalents.

According to the washing machine and its control method according to an embodiment, by determining whether to add a softener based on the turbidity of water inside the tub during a rinsing cycle, and circulating the water inside the tub when the softener is injected, bubbles are provided into the tub, so that it is possible to increase the adsorption rate of the softener to laundry.

DESCRIPTION OF SYMBOLS

1: washing machine
110: input
120: turbidity sensor
130: storage
140: controller
150: water supplier
160: motor
170: pump
180: circulation bubble device

What is claimed is:

1. A washing machine comprising:
a tub configured to accommodate a drum;
a detergent supplier including:
a detergent storage space to store detergent; and
a softener storage space to store a softener;
a water supplier configured to supply water to the tub through the detergent supplier;
a turbidity sensor configured to detect turbidity of water in the tub;
a bubble circulator configured to perform a circulation operation of circulating water in the tub and resupplying the water to the tub, or a bubble supply operation of generating bubbles and supplying the generated bubbles to the tub; and
a controller configured to:
in response to the detected turbidity of the water in the tub being higher than a first reference value, control the water supplier to perform a first rinsing cycle using the supplied water without the softener; and
in response to the detected turbidity of the water in the tub, after the first rinsing cycle is completed, being lower than the first reference value, control the water supplier to supply water containing the softener to the tub, and control the bubble circulator to perform a second rinsing cycle by alternately performing the circulation operation and the bubble supply operation.

2. The washing machine of claim 1, wherein
the controller is further configured to compare the detected turbidity of the water with the first reference value in response to the first rinsing cycle being completed, and
control the water supplier to perform the first rinsing cycle again in response to the detected turbidity of the water of the tub being higher than the first reference value.

3. The washing machine of claim 1, wherein
the controller is further configured to compare the detected turbidity of the water with a second reference value in response to the second rinsing cycle being completed, and
control the bubble circulator to stop performing the circulation operation and the bubble supply operation, and control the washing machine to perform a bubble reduction cycle in response to the detected turbidity of the water of the tub being higher than the second reference value.

4. The washing machine of claim 3, wherein
the controller is further configured to control the washing machine to discharge the water from the tub in response to the detected turbidity of the water in the tub being lower than the second reference value.

5. The washing machine of claim 4, wherein
the controller is further configured to control the washing machine to perform a dehydration cycle after the water is discharged from the tub.

6. The washing machine of claim 3, wherein
the controller is further configured to determine the turbidity of water supplied to the tub as a reference turbidity value in response to the first rinsing cycle being initiated, and determine the first reference value and the second reference value based on the reference turbidity value.

7. The washing machine of claim 1, further comprising:
an interface configured to receive a user input; and
wherein the controller is configured to control the washing machine to perform the first rinsing cycle and the second rinsing cycle in response to a softening course being received as the user input from through the interface.

8. The washing machine of claim 1, wherein the turbidity sensor is provided inside a lower side of the tub.

9. The washing machine of claim 1 further comprising:
a pump configured to discharge water from the tub; and
wherein the bubble circulator includes:
a switch configured to selectively form a circulation passage for resupplying water discharged from the pump to the tub and a bubble supply passage to generate bubbles in the water discharged from the pump and to supply the generated bubbles to the tub; and a driver configured to drive the switch.

10. The washing machine of claim 9, wherein the controller is further configured to control the driver so that water discharged from the pump alternately passes through the circulation passage and the bubble supply passage.

* * * * *